United States Patent [19]

Leinoff

[11] Patent Number: 4,485,493

[45] Date of Patent: Dec. 4, 1984

[54] CONVERTIBLE CLOTHING ARTICLE

[76] Inventor: David Leinoff, 71 Park Avenue, New York, N.Y. 10016

[21] Appl. No.: 531,442

[22] Filed: Sep. 12, 1983

[51] Int. Cl.[3] ..... A41B 3/02

[52] U.S. Cl. ..... 2/86; 2/72

[58] Field of Search ..... 2/86, 85, 72, 213

[56] References Cited

U.S. PATENT DOCUMENTS 1,533,952 4/1925 Shatron ..... 2/86

2,186,918 1/1940 Wolf ..... 2/86

*Primary Examiner*—Doris L. Troutman

*Attorney, Agent, or Firm*—P. A. Razzano

[57] ABSTRACT

A clothing article is disclosed which comprises a garment having interconnected shoulders, back and front sides adapted to cover the body of a wearer. The front sides of the garment have separate front edges including a facing portion folded over the front edges to the interior of the garment. The front sides and back define a continuous bottom edge for the garment with the back having a vent formed therein extending from the bottom edge part way up the back. The facing along the front edges of the garment includes a selectively openable flap portion extending upwardly a predetermined distance from the bottom edge of the garment and means are provided for selectively securing the flap portion of the facing in a first position to the inside of the front edges of the garment to form a coat and other means are provided for selectively securing the flaps in a second position to the inside of the back of the garment adjacent the vent to form a culotte.

9 Claims, 7 Drawing Figures

CONVERTIBLE CLOTHING ARTICLE

The present invention relates to a convertible garment, and more particularly, to a coat which can be converted into a pair of culottes.

In the world of fashion, it is particularly desirable among ladies to have a range of garments in different styles. With extremely expensive garments, such as, for example, coats or furs, the ability to own a range of styles of such garments becomes less practical. Therefore, for example, it is usual for a woman to own only a single fur coat.

It is an object of the present invention to provide a garment construction which will enable the style of the garment to be conveniently and readily changed from a coat to a culotte-type garment.

Another object of the present invention is to provide a convertible coat.

A further object of the present invention is to provide a fur coat construction which will enable the wearer to use the coat as a conventional coat or as a pair of culottes.

A still further object of the present invention is to provide a convertible garment which is readily manufactured and durable in use.

Yet another object of the present invention is to provide a convertible coat which is simple in construction and relatively easy to manufacture.

In accordance with an aspect of the present invention, a convertible clothing article such as, for example, a fur coat, is provided which is adapted to cover the body of the wearer. The garment, in this case, a coat, has inner and outer surfaces and front and back sides which include a lower edge that defines a continuous bottom edge for the coat. The back of the coat has a vent formed in it extending upwardly from the bottom edge of the coat a predetermined distance. The front side of the garment has a pair of adjacent edges defining the front opening of the coat and the front edges each include a lower flap having a free edge. Means, such as hooks or snaps, are provided for selectively securing the free edge of the flaps in a first position to the inner surfaces of the coat adjacent their associated front edge to define a facing portion for the garment in the first position and to define a front opening in the garment. Additional means, such as, for example, additional hooks or snaps, are provided for securing the free edges of the flaps in a second position to the back of the garment adjacent the vent in order to form pant legs in the garment whereby the garment is in the form of culottes.

The above, and other objects, features and advantages of the present invention will be apparent in the following detailed description of an illustrative embodiment thereof, which is to be read in connection with the accompanying drawings, wherein.

Figure 1:
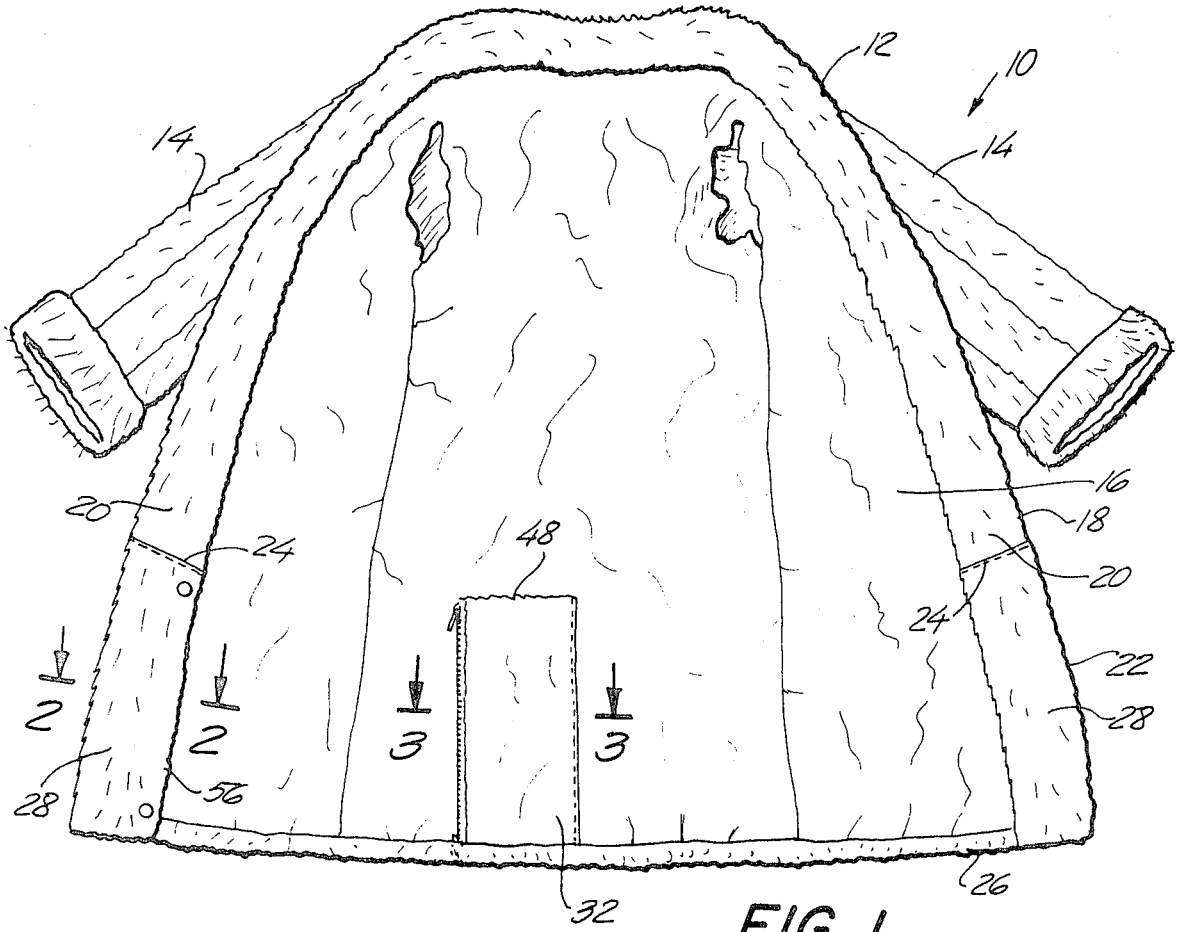
FIG. 1 is a plan view of a fur coat made in accordance with the present invention showing the interior of the coat.
Figure 2:
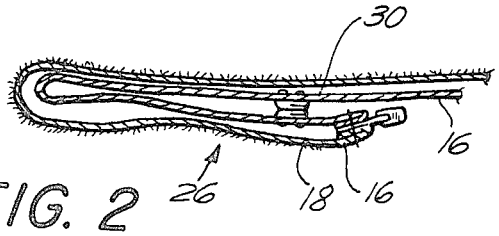
FIG. 2 is a sectional view taken along line 2—2 of FIG. 1.

Referring now to the drawings in detail, and initially to FIG. 1 thereof, a coat 10, constructed in accordance with the present invention, is illustrated. The overall appearance and shape of the coat 10 is of conventional construction in that it includes shoulders 12, sleeves 14, an interior surface which is lined with a fabric or the like 16, and an outer surface 18 formed of fur pelts in a conventional manner.

FIG. 1 of the drawing illustrates the configuration of the garment when the components are connected to form the coat configuration. By the construction of the invention, as described hereinafter, the coat can be converted from its form in FIG. 1 to its form in FIG. 6 wherein it takes on the appearance of culottes.

More specifically, the coat 10 includes a facing or inner edge 20 along each of its front edges 22. In the conventional construction of coats, particularly fur coats, the outer surface material, namely, the fur 18, is folded over along the front edge of the coat to form an inner facing or border. This same construction is also used with conventional cloth coats and while the invention is described herein with reference particularly to fur coats, it will be appreciated that any outer surface material conventionally used for coats, for example, any conventional cloth material, can be used for the outer surface material of the coat of the present invention in lieu of the fur.

The facing 20 is slit along an inclined line 24 at a predetermined distance above the bottom edge 26 of the coat. This distance is selected so that in the culotte form of the configuration of the garment, the lower part 28 of the facing forms a portion of the leg of the culotte while permitting free movement of the wearer's legs for walking.

The facing portion 28 between the bottom edge of the coat and the slit 24 is held against the inner face of the coat in the first position thereof illustrated in FIG. 1 by one or more conventional snaps 30. As seen in FIG. 1, the snaps 30 are secured to the inner lining 16 behind the lower portion of the facing 28 (also referred to hereinafter as a "flap"). These snaps (preferably there are two, one at the top and one at the bottom of the flap) hold the flap in alignment with the remainder of the facing so that the coat, in this configuration, has the appearance of a conventional coat construction.

Figure 3:
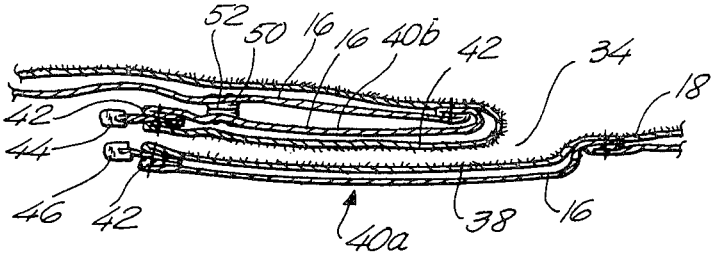
FIG. 3 is a sectional view taken along line 3—3 of FIG. 1.

The coat 10 also includes a vent extension 32 located at the middle of the back of the coat. This extension has two panel portions which give the appearance of a vent 34, as seen in FIG. 3. One panel portion **40*a* is formed by an extension 38 of the back fur surface to which a portion of the inner lining 16 is secured. The other panel portion 40*b* is formed by a folded over portion 42 of the fur to which, as seen in FIG. 3, the lining 16 is secured. Each of the vent extensions or panels 40*a*, 40*b* has a free edge 42 to which one side of two zippers 44, 46 are respectively secured. The two extensions 40*a* and 40*b* are sewn together along their top edge 48**, as seen in FIG. 1, in order to form an essentially unitary structure.

The inner facing 16 of the extension **40*b* has a pair of snaps 50 of conventional construction secured thereto for engagement with complementary snap portions 52 on the back of the coat in order to hold the vent down in the position shown in FIG. 1 when the coat is in its coat-like form. The free edges 42** and the bottom edge of the vent extensions in this configuration are not connected.

Figure 4:
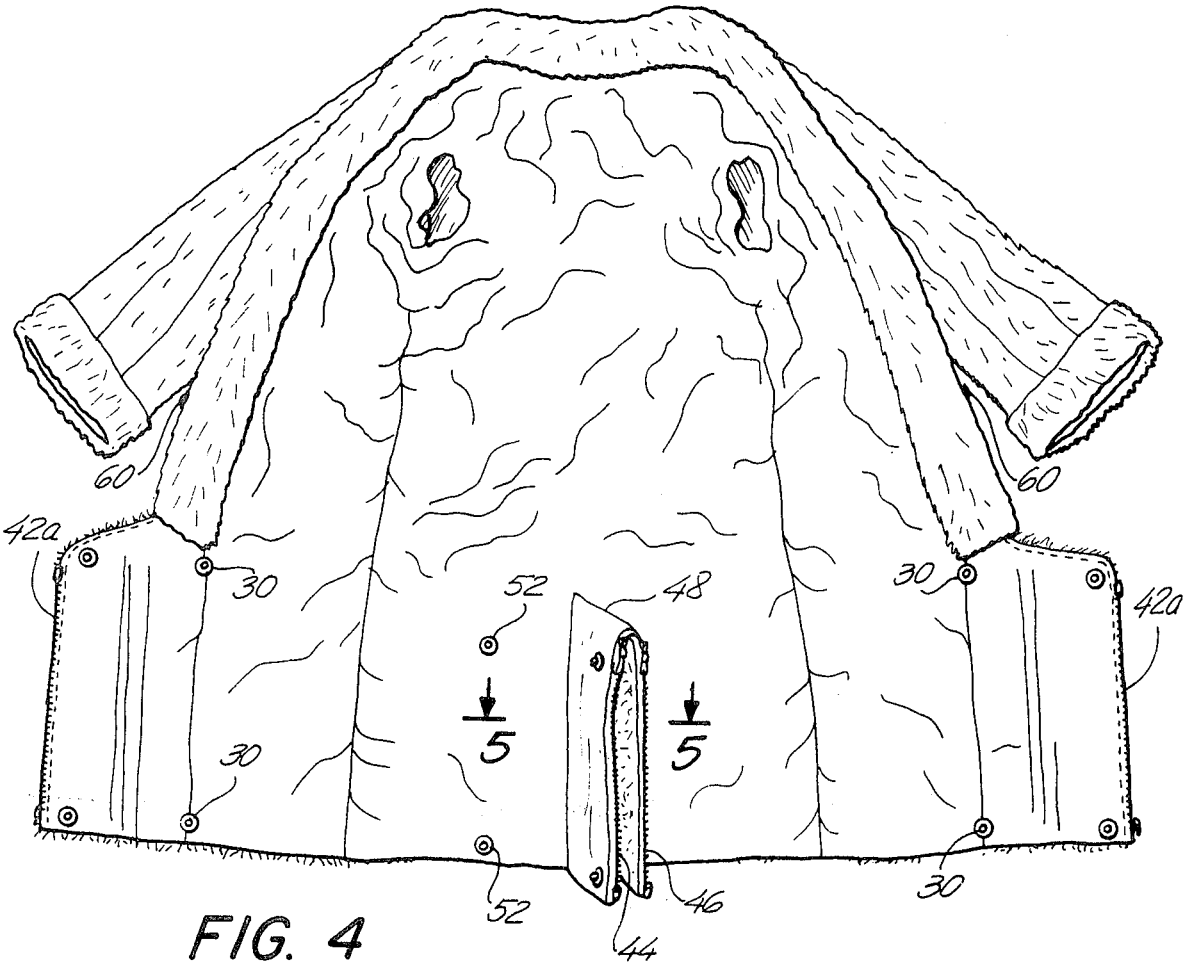
FIG. 4 is a view similar to FIG. 1, but showing the flaps and vent of the coat open in preparation for converting the coat to culottes.

When it is desired to convert the coat of FIG. 1 to culottes, the snaps 30 on the flaps 28 are released, as are the snaps 50, 52 for the vent extensions, as seen in FIG. 4. In this regard, it is noted that the free edge 56 of the facing flaps 28 have zipper portions 44*a*, 46*a*, respectively, sewn thereon which are respectively complementary to the zipper portions 44, 46 on the vent flap.

Figure 5:
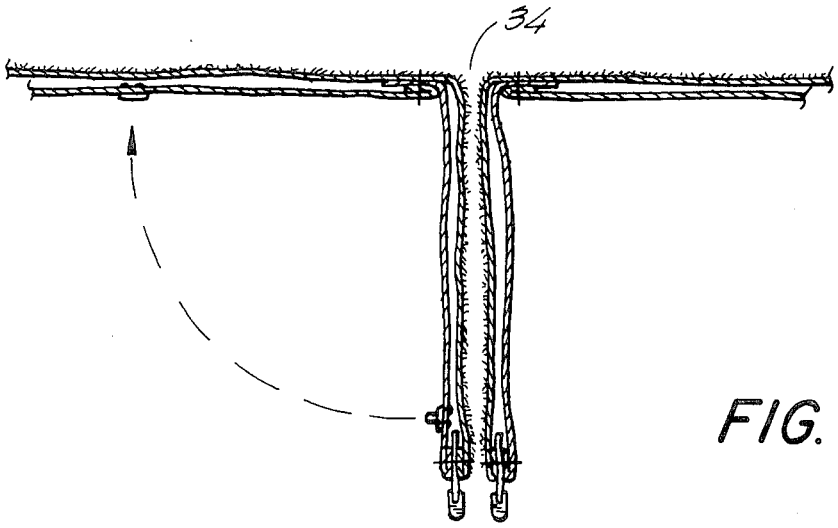
FIG. 5 is a sectional view taken along line 5—5 of FIG. 4.
Figure 6:
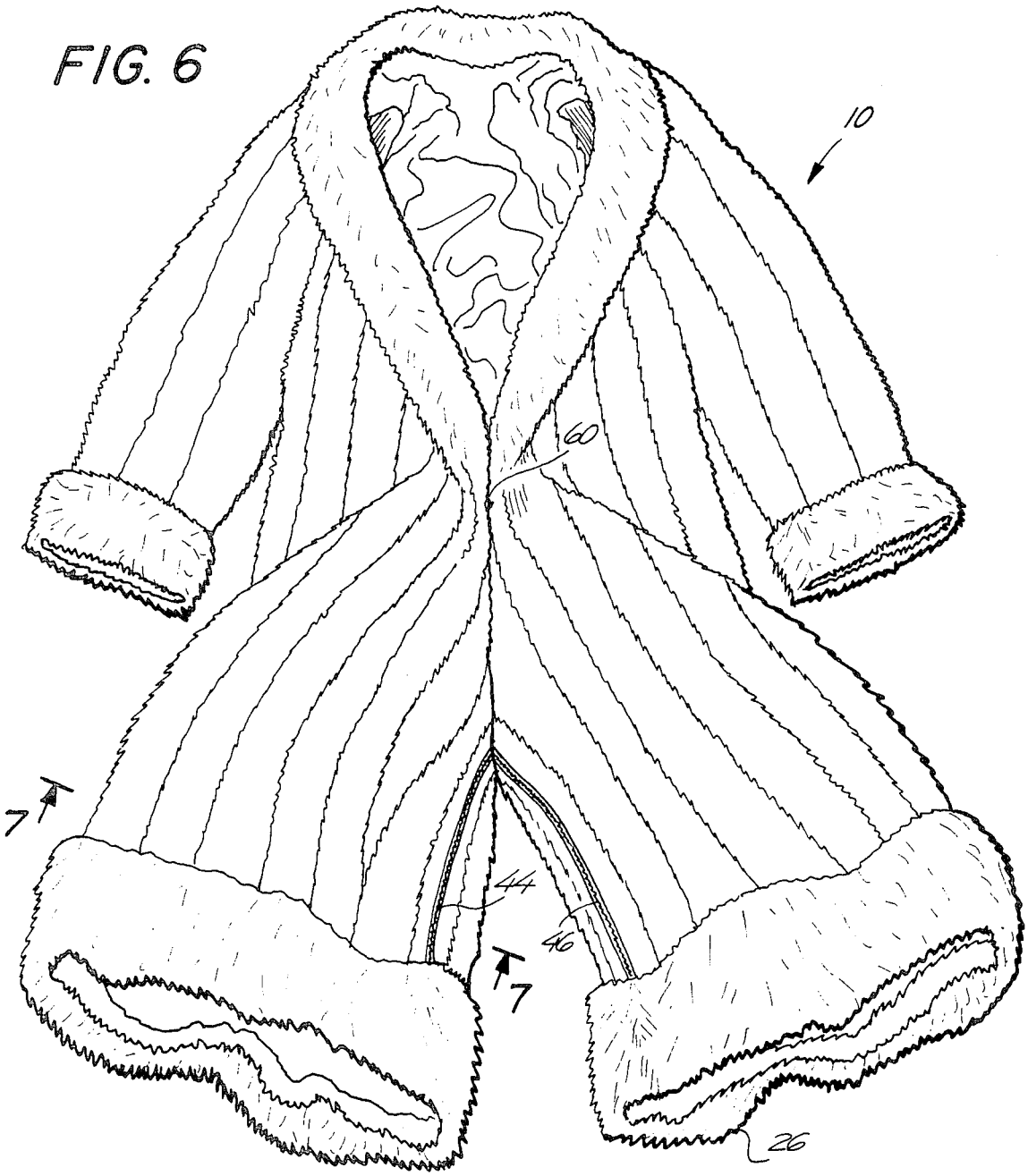
FIG. 6 is an elevational view showing the coat arranged in its culotte form.

With the coat open in this configuration, the vent 34 is open, as seen in FIG. 5, except where the flap elements are connected together along the edge 48. The zipper portions 44*a*, 44 and 46*a*, 46 can then be zipped together to form pant legs for the garment, as illustrated in FIG. 6. In this configuration, the seam 48 forms the crotch portion of the garment at the rear.

Figure 7:
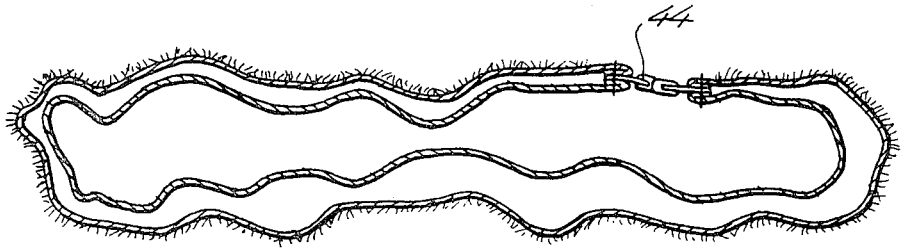
FIG. 7 is a sectional view taken along line 7—7 of FIG. 6.

Spaced slightly above the flaps of the garment on each edge of the coat are the two halves of a conventional hook and eye arrangement 60 (also known in the art as a French hook) which, in the culotte form of the coat, are connected in order to draw the front edges of the coat together as seen in FIG. 7. This provides improved definition to the shape of the coat in creating the appearance of pant legs by the constructions described above.

When it is desired to return the coat to its conventional coat configuration, the zippers are undone and the snaps reconnected to return the coat to the configuration of FIG. 1.

Accordingly, it is seen that a relatively simply constructed coat is provided which is convertible from a coat configuration to a culotte construction. As a result, relatively expensive garments can be provided which will give two distinct styles and appearances to the wearer, expanding the wearer's wardrobe without an increase in cost or duplication of garments.

Although an illustrative embodiment of the invention has been described herein with reference to the accompanying drawings, it will be understood that the invention is not limited to that precise embodiment, and that various other changes and modifications may be effected therein by one skilled in the art without departing from the scope or spirit of this invention.

What is claimed:

1. A convertible clothing article comprising a garment having interconnected shoulders, back and front sides adapted to cover the body of a wearer, said front sides having separated front edges, said front including a facing portion folded over said front edges to the interior of the garment and said front, sides and back defining a continuous bottom edge for the garment, said back having a vent formed therein extending from said bottom edge part way up the back, said facing including a selectively operable flap portion extending upwardly a predetermined distance from said bottom edge, means for selectively securing said flap portion in a first position to the inside of the front edges of the garment to form a coat and means for selectively securing said flaps in a second position to the inside of the back of the garment adjacent said vent to form culottes.

2. A convertible clothing article comprising a garment for covering the body having inner and outer surfaces and front and back sides including a lower edge defining a continuous bottom edge for the garment, said back having a vent formed therein extending upwardly from said bottom edge a predetermined distance; said front side of the garment having a pair of adjacent edges defining a front opening in the garment; said front edges each including a lower flap having a free edge, means for selectively securing said free edge of said flaps in a first position to the inner surfaces of the garment adjacent their associated front edge to define a facing portion of the garment in said first position and to define a front opening garment; and means for securing said free edges of said flaps in a second position to the back adjacent said vent to form pant legs in said garment.

3. The convertible clothing article as defined in claim 2 wherein said means for securing said free edges of said flaps to the back of the garment comprises a pair of panels respectively secured at one edge to opposite sides of said vent and located inwardly from the outer surface of the back, said panels having free ends including means for respectively securing the panel free ends to the free ends of the flaps.

4. The convertible clothing article as defined in claim 3 wherein said panels have upper edges and said upper edges are secured together whereby the top portions of the panels define a portion of the crotch of garment when the free edges of the flaps and panels are secured together.

5. The convertible clothing article as defined in claim 4 including means for selectively securing said panels together in a first position to the inner surface of the garment's back when the flaps are secured to the inner surface of the front to conceal the panels from view.

6. The convertible clothing article as defined in claim 5 wherein said front edges of the front of the garment have a facing and said flaps form a portion of said facing in said first position thereof.

7. The convertible clothing article as defined in claim 6 wherein said garment is a coat.

8. The convertible clothing article as defined in claim 6 wherein said garment is a fur coat in which said outer surface is fur and said inner surface is a lining, said facing being defined by a portion of said fur being folded over said front edges.

9. The method of forming a convertible clothing article for covering the body with a garment having inner and outer surfaces and front and back sides with a continuous lower edge comprising the steps of forming a vent in the garment extending upwardly from the bottom edge for a predetermined distance; forming a pair of front edges in the garment to define a front opening and forming a lower flap at each of said front edges with said flaps each having a free edge, selectively securing the free edges of the flaps in a first position to the inner surface of the garment adjacent their associated front edges to define a facing portion of the garment in said first position and to define a front opening garment; and selectively securing the free edges of said flaps in a second position to the back adjacent the vent to form a pair of pant legs in the garment.

* * * * *